US009451662B1

(12) United States Patent
Chung et al.

(10) Patent No.: US 9,451,662 B1
(45) Date of Patent: Sep. 20, 2016

(54) ALTERNATING CURRENT LIGHT EMITTING DEVICE

(71) Applicant: PARAGON SEMICONDUCTOR LIGHTING TECHNOLOGY CO., LTD., New Taipei (TW)

(72) Inventors: Chia-Tin Chung, Miaoli County (TW); Shih-Neng Tai, Taoyuan County (TW)

(73) Assignee: PARAGON SEMICONDUCTOR LIGHTING TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/867,993

(22) Filed: Sep. 28, 2015

(51) Int. Cl.
*H05B 37/02* (2006.01)
*H05B 33/08* (2006.01)

(52) U.S. Cl.
CPC ..... *H05B 33/0815* (2013.01); *H05B 33/0854* (2013.01)

(58) Field of Classification Search
CPC .. H05B 37/02; H05B 33/08; H05B 33/0812; H05B 33/0815; H05B 33/0842; H05B 33/0845
USPC ..... 315/185 R, 187, 200 R, 224–226, 291, 315/307, 308, 312
See application file for complete search history.

(56) References Cited

U.S. PATENT DOCUMENTS 8,981,657 B2 * 3/2015 Su ..... H05B 33/0815 315/224

* cited by examiner

*Primary Examiner* — Jimmy Vu
(74) *Attorney, Agent, or Firm* — Li & Cai Intellectual Property (USA) Office

(57) ABSTRACT

Disclosed is an AC light emitting device. The AC light emitting device is electrically connected to an AC power, and the AC power is rectified by a rectification module and inputs an input voltage. The AC light emitting device comprises a buck module, a switching unit, a control module and an AC lighting emitting module. The buck module is electrically connected to the rectification module. The switching unit is electrically connected to the rectification module and the buck module. The control module is electrically connected to the switching unit and the buck module. The AC lighting emitting module is electrically connected to the switching unit. The control module outputs a pulse waveform signal to the switching unit according to the input voltage and a dimming signal, and the switching unit turns on or off the AC lighting emitting module according to the pulse waveform signal.

10 Claims, 6 Drawing Sheets

ALTERNATING CURRENT LIGHT EMITTING DEVICE

BACKGROUND OF THE INVENTION

1. Field of the Invention

The instant disclosure relates to an AC light emitting device; in particular, to an AC light emitting device for illumination.

2. Description of Related Art

The light emitting diode (LED) has low power consumption, high luminosity and long life-time, and thus LED has been widely used in many kinds of lighting devices. The lighting device comprises the rectifying circuit, the switch, the light emitting module and the current source. The light emitting module comprises a plurality of LEDs connected in series. For illustration, the rectifying circuit can be the full-wave rectifying circuit. Thus, the pulse DC current can be obtained after the AC power is rectified via the rectifying circuit, and the pulse DC current is provided as the input power of the LEDs. When the LEDs in series are turned on, the current source can provide a stable current to each LED in the light emitting module.

However, usually the luminosity of the lighting device is switched via the group loop control method, and the switch can turn on, partially turn on or turn off the light emitting module. For example, the user operates the switch once to make the light emitting module turn on, operates the switch twice to make the light emitting module partially turn on, and operates the switch three times to make the light emitting module turn off.

Thus, the above operation may result in various luminosities within the area where the lighting device emits lights. For example, the area where the light emitting module turns on has a high luminosity, but the area where the light emitting module turns off has a low luminosity.

In addition to the above problem, in the case that the light emitting module partially turns on within certain area, some of LEDs are frequently used which result in their shorter lifetime or the risk of being damaged because of the over current.

SUMMARY OF THE INVENTION

The instant disclosure provides an AC light emitting device. Via outputting a pulse waveform signal to the switching unit according to the input voltage and a dimming signal, the dimming signal outputs lights with different luminosities, so as to increase the convenience for using the AC light emitting device.

The instant disclosure provides an AC light emitting device electrically connected to an AC power. The AC power is rectified by a rectification module and inputs an input voltage. The AC light emitting device comprises a buck module, a switching unit, a control module and an AC lighting emitting module. The buck module is electrically connected to the rectification module. The switching unit is electrically connected to the rectification module and the buck module. The control module is electrically connected to the switching unit and the buck module. The AC lighting emitting module is electrically connected to the switching unit. The control module outputs a pulse waveform signal to the switching unit according to the input voltage and a dimming signal, and the switching unit turns on or off the AC lighting emitting module according to the pulse waveform signal.

To sum up, in the AC light emitting device provided by the instant disclosure, the control module outputs a pulse waveform signal to the switching unit according to the input voltage and a dimming signal. The switching unit turns on or off the AC lighting emitting module according to the pulse waveform signal, such that the AC lighting emitting module outputs lights with different luminosities. Moreover, in the AC light emitting device provided by the instant disclosure, the dimmer module is configured to adjust the predetermined dimming mode of the control module, so as to increase the convenience for using the AC light emitting device.

For further understanding of the instant disclosure, reference is made to the following detailed description illustrating the embodiments of the instant disclosure. The description is only for illustrating the instant disclosure, not for limiting the scope of the claims.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF PREFERRED EMBODIMENTS

Figure 1A:
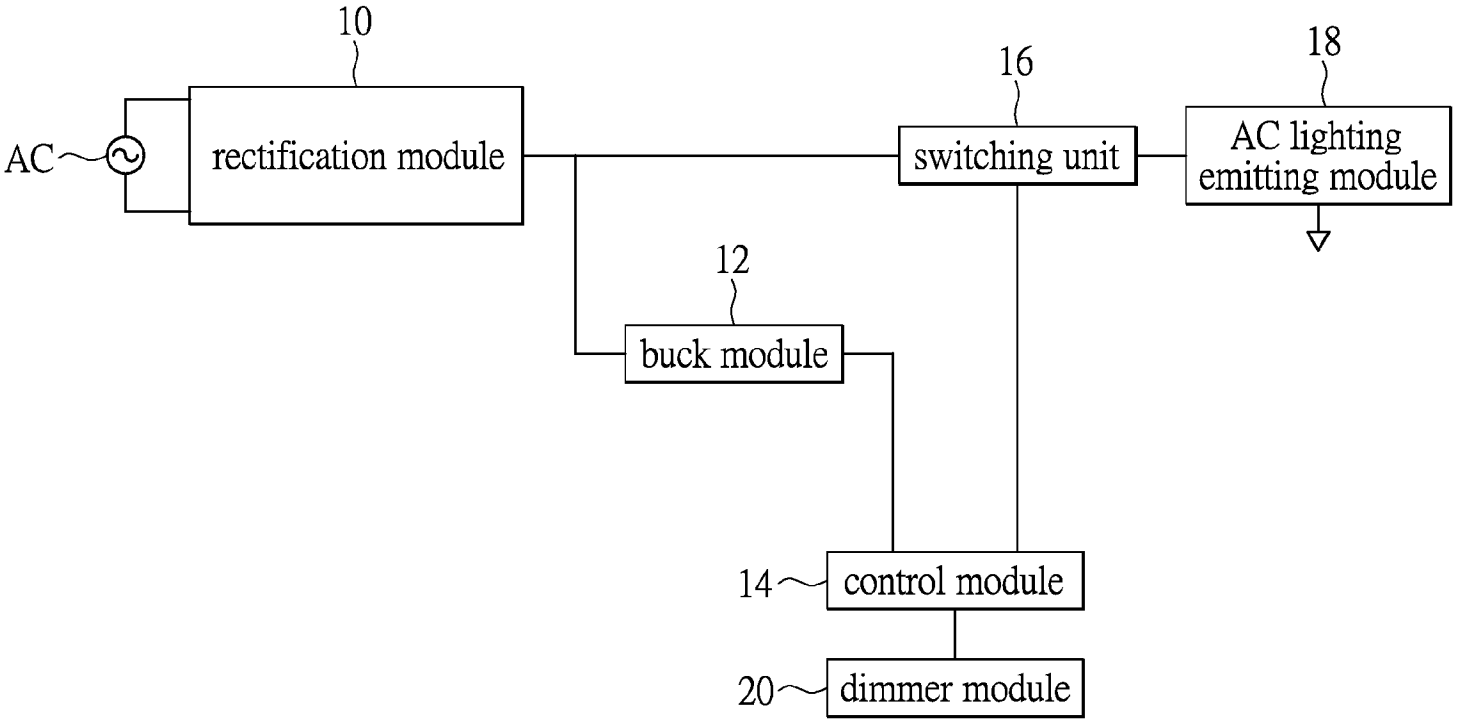
FIG. 1A shows a block diagram of an AC light emitting device of one embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the instant disclosure. As used herein, the term "and/or" includes any and all combinations of one or more of the associated listed items.

FIG. 1A shows a block diagram of an AC light emitting device of one embodiment of the instant disclosure. Please refer to FIG. 1A. The AC light emitting device is electrically connected to an AC power, and the AC power is rectified via a rectification module 10 and the rectification module 10 outputs an output voltage. The AC light emitting device 1 comprises a buck module 12, a switching unit 16, a control module 14, a dimmer module 20 and an AC lighting emitting module 18. In practice, the buck module 12 is electrically connected to the rectification module 10, the switching unit 16 and the control module 14. The switching unit 16 is electrically connected to the rectification module 10, the buck module 12, the control module 14 and the AC lighting emitting module 18. The dimmer module 20 is electrically connected to the control module 14.

The AC power of 110V, 220V or other voltage value is provided to the AC light emitting device 1, and the type of the AC power is not limited herein. The rectification module 10 is configured to rectify the AC power to output an input voltage. In practice, the rectification module 10 can be a full-bridge rectifying circuit or a half-bridge rectifying circuit, and it is not limited herein.

Via the rectification module 10, the AC power is turned into a pulse direct voltage, which is provided as an input voltage of the control module 14. More precisely, the pulse direct voltage can be full-wave or half-wave. For convenience, the rectification module 10 can be a full-bridge rectifying circuit, to rectify the AC power to an input voltage that the control module 14 and the AC lighting emitting module 18 can use, such as the full-wave pulse direct voltage within its positive half period. In another embodiment, the input voltage can be the half-wave pulse direct voltage within its positive half period, but the type of the input voltage is not limited herein. In the following description, the full-wave pulse direct voltage within its positive half period is taken for example.

The buck module 12 is configured to lower the input voltage to a predetermined voltage. For example, the input voltage is lowered to a working voltage that the control module 14 needs, such as 5V. The buck module 12 can be implemented via a buck circuit, a voltage divider circuit or other circuits, and the type of the buck module 12 is not limited herein.

The switching unit 16 can be one or more power transistors, or one or more field-effect transistors, and the type of the switching unit 16 is not limited herein. In practice, the switching unit 16 is controlled by the control module 14. When the switching unit 16 is turned on, the AC power is rectified via the rectification module 10 and then provided to the AC lighting emitting module 18. On the other hand, when the switching unit 16 is turned off, the AC power cannot provide power to the AC lighting emitting module 18.

The AC lighting emitting module 18 can be implemented by one or several serial AC light emitting diodes, one or more AC light emitting diodes in parallel, or the AC light emitting diodes in a bridge circuit form, and the type of the AC lighting emitting module 18 is not limited herein. Regardless of the direction of the AC power, the AC lighting emitting module 18 can be always biased and emit light.

The control module 14 is electrically connected to the switching unit 16, the buck module 12 and the dimmer module 20. In practice, the control module 14 can be a microprocessor, a control chip, a processing chip or a control circuit, and the type of the control module 14 is not limited herein. Also, the control module 14 has a plurality of predetermined dimming modes, which make the control module 14 output the pulse waveform signals with different duty cycles to the switching unit 16. The control module 14 generates the pulse waveform signal according to a pulse-triggering phase and the input voltage.

Specifically speaking, the control module 14 outputs a pulse waveform signal to the switching unit 16 according to the input voltage and a dimming signal. The switching unit 16 is turned on or off to make the AC lighting emitting module 18 output a light according to the pulse waveform signal. In practice, the pulse waveform signal is generated according to the waveform of the positive half wave of the input voltage, which is like a PWM signal. The switching unit 16 turns on or off the circuit between the AC power AC and the AC lighting emitting module 18 according to the pulse waveform signal, such that the AC lighting emitting module 18 can output lights with different luminosities.

Moreover, the dimmer module 20 can be a switching knob, a switching button, a switch or a wall switch, and the type of the dimmer module 20 is not limited herein. The dimmer module 20 has a plurality of dimming scales, and one of the dimming scales makes the control module 14 output the pulse waveform signals having different duty cycles to the switching unit 16.

For example, the dimmer module 20 is a switching knob, and has four dimming scales of which the luminosities can be 100%, 75%, 25% and 0%. When the switching knob is switched to the scale with 75% luminosity, the dimmer module 20 outputs the corresponding dimming signal to the control module 14, and the control module 14 outputs the pulse waveform signal having 75% dimming duty cycle to the switching unit 16 according to the predetermined dimming mode having 75% dimming duty cycle. Thereby, the AC lighting emitting module 18 outputs a light having 75% luminosity.

In another case, when the switching knob is switched to the scale with 25% luminosity, the control module 14 outputs a pulse waveform signal having the 25% dimming duty cycle to the switching unit 16 according to the predetermined dimming mode having 25% dimming duty cycle. Thereby, the AC lighting emitting module 18 outputs a light having 25% luminosity. However, the operation type of the AC light emitting device 1 is not limited herein.

Figure 1B:
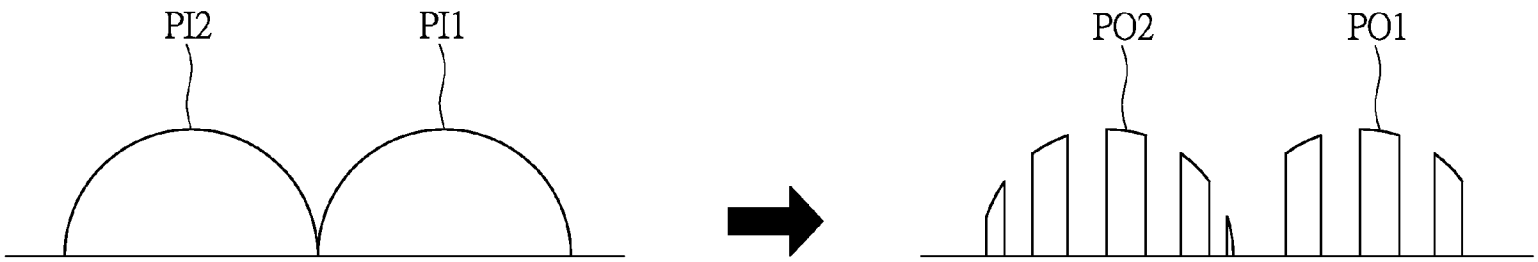
FIG. 1B shows a schematic drawing for converting the input voltage to the pulse waveform signal via a control module according to another embodiment shown in FIG. 1A.

FIG. 1B shows a schematic drawing for converting the input voltage to the pulse waveform signal via a control module according to another embodiment shown in FIG. 1A. The voltage waveforms of the input voltages PI1 and PI2, and the voltage waveforms of the pulse waveform signals PO1 and PO2 are shown in FIG. 1B. The input voltages PI1 and PI2 are generated after the AC power is rectified via the rectification module 10. The input voltages PI1 and PI2 are, for example, the pulse direct voltage of the positive half wave.

The pulse waveform signals PO1 and PO2 are the voltage waveforms generated according to the pulse-triggering phase and the input voltage. The pulse waveform signals PO1 and PO2 are generated according to the waveform of the positive half wave of the input voltages PI1 and PI2, which is like a PWM signal. The pulse-triggering phase would affect the duty cycles of the pulse waveform signals PO1 and PO2.

For example, the pulse waveform signal PO1 is a pulse waveform signal having the 75% dimming duty cycle, and the pulse waveform signal PO2 is a pulse waveform signal having the 100% dimming duty cycle. The control module 14 outputs the pulse waveform signals PO1 and PO2 having different duty cycles to the switching unit 16, so as to control the luminosity of the AC lighting emitting module 18. In this case, the turn-on time duration of the duty cycle of the pulse waveform signal PO1 is larger than the turn-on time duration of the duty cycle of the pulse waveform signal PO2. The waveform type of the pulse waveform signals PO1 and PO2 is not limited herein.

The following description illustrates the details of the AC light emitting device 1.

Figure 2:
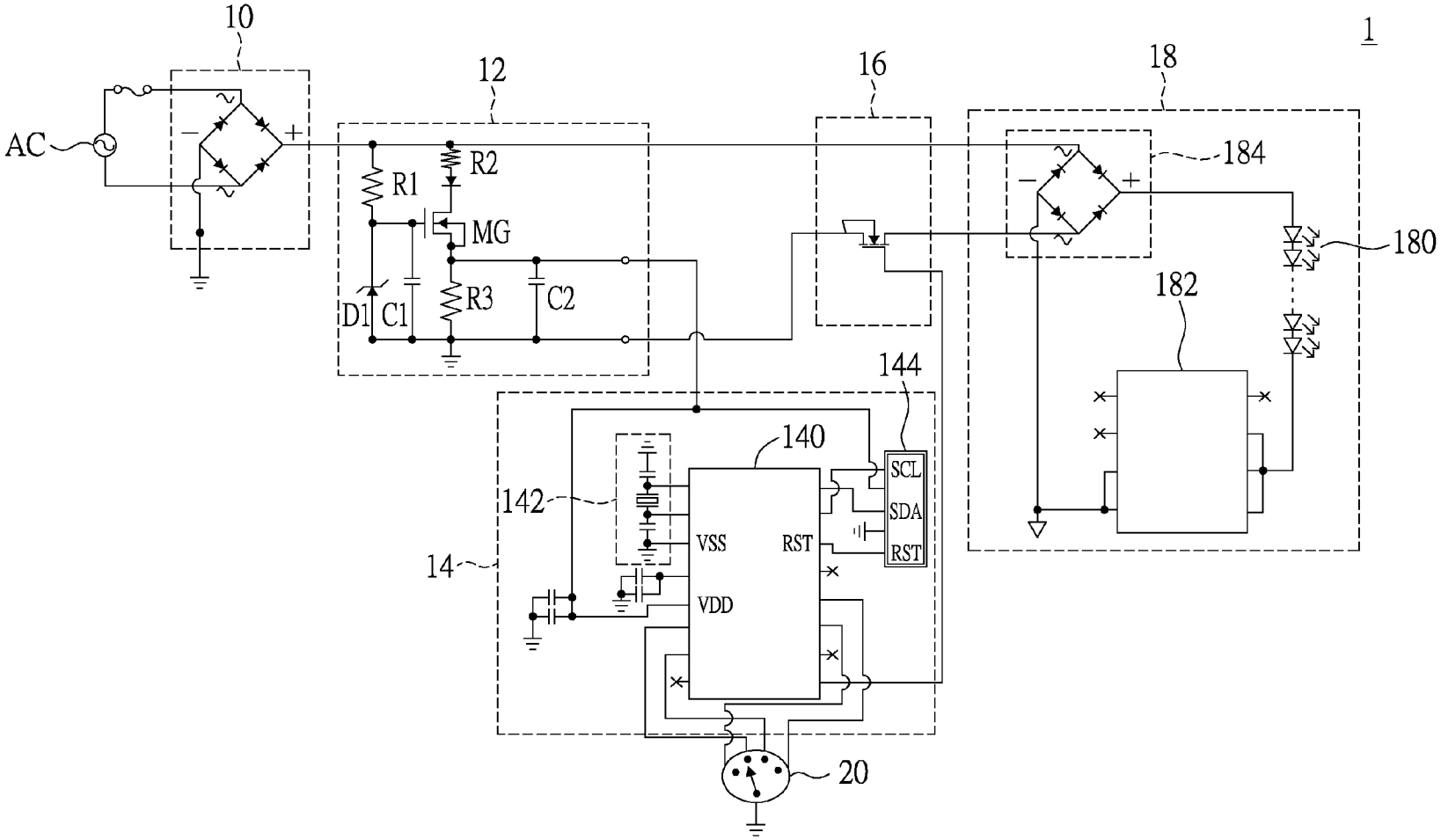
FIG. 2 shows a circuit diagram of an AC light emitting device according to another embodiment shown in FIG. 1A.

FIG. 2 shows a circuit diagram of an AC light emitting device according to another embodiment shown in FIG. 1A. Please refer to FIG. 2 and FIG. 1A. The AC light emitting device is electrically connected to an AC power, and an input voltage is generated after the AC power is rectified via the rectification module 10. The AC light emitting device 1 comprises a buck module 12, a switching unit 16, a control module 14, a dimmer module 20 and an AC lighting emitting module 18.

Specifically speaking, the buck module 12 comprises a plurality of resistors R1~R3, a diode D1, a transistor switch MG and a plurality of capacitors C1~C2. The gate of the transistor switch MG is electrically connected to one of the resistors R1~R3 and the cathode of the diode D1. The anode of the diode D1 is electrically connected to the source of the transistor switch MG. The resistors R1~R3 can be a first resistor R1, a second resistor R2 and a third resistor R3. The first resistor R1 is electrically connected to the cathode of the diode D1, the gate of the transistor switch MG and the rectification module 10. The second resistor R2 is electrically connected to the drain of the transistor switch MG and the rectification module 10. The capacitor C2 is connected to the third resistor R3 in parallel, as shown in FIG. 2.

The switching unit 16 can be a power transistor. The gate of the power transistor is electrically connected to the control module 14. The source and the drain of the power transistor are electrically connected to the buck module 12 and the AC lighting emitting module 18, respectively. The functions of the power transistor should be well understood by those skilled in the art and thus the related description is omitted herein.

The control module 14 comprises a control unit 140, an oscillation unit 142 and a coding unit 144. In practice, the control unit 140 is electrically connected to the buck module 12, the oscillation unit 142 and the coding unit 144. The oscillation unit 142 is configured to count time, so as to make the control unit 140 do a precise dimming with time counting. In other embodiments, the control module 14 has a built-in oscillator. Thus, the control module 14 can have the oscillation unit 142, or not have it, to do a dimming with time counting. The type of the control module 14 is not limited herein.

It is worth mentioning that, the coding unit 144 has a serial clock (SCL) pin, a serial data (SDA) pin, a reset (RST) pin, and the like. The SCL pin, the SDA pin, the RST pin and the like are electrically connected to the control unit 140 respectively. Also, the coding unit 144 is configured to receive the predetermined voltage output by the buck module 12, such as a working voltage of 5V.

The AC lighting emitting module 18 comprises a rectification unit 184, an AC operation unit 182 and at least one AC light emitting diode 180. The rectification unit 184 is electrically connected to the AC operation unit 182 and at least one AC light emitting diode 180. The AC light emitting diode 180 can be an AC-LED, designed as a Wheatstone Bridge. Regardless of the direction of the AC power, the AC lighting emitting module 18 can be always biased and emit light, as shown in FIG. 2.

The rectification unit 184 can be a full-bridge or half-bridge rectifying circuit, and the type of the rectification unit 184 is not limited herein. In addition, the AC operation unit 182 can be an AC performance chip, a bridge performance chip or circuit, and the type of the AC lighting emitting module 18 is not limited herein.

Figure 3:
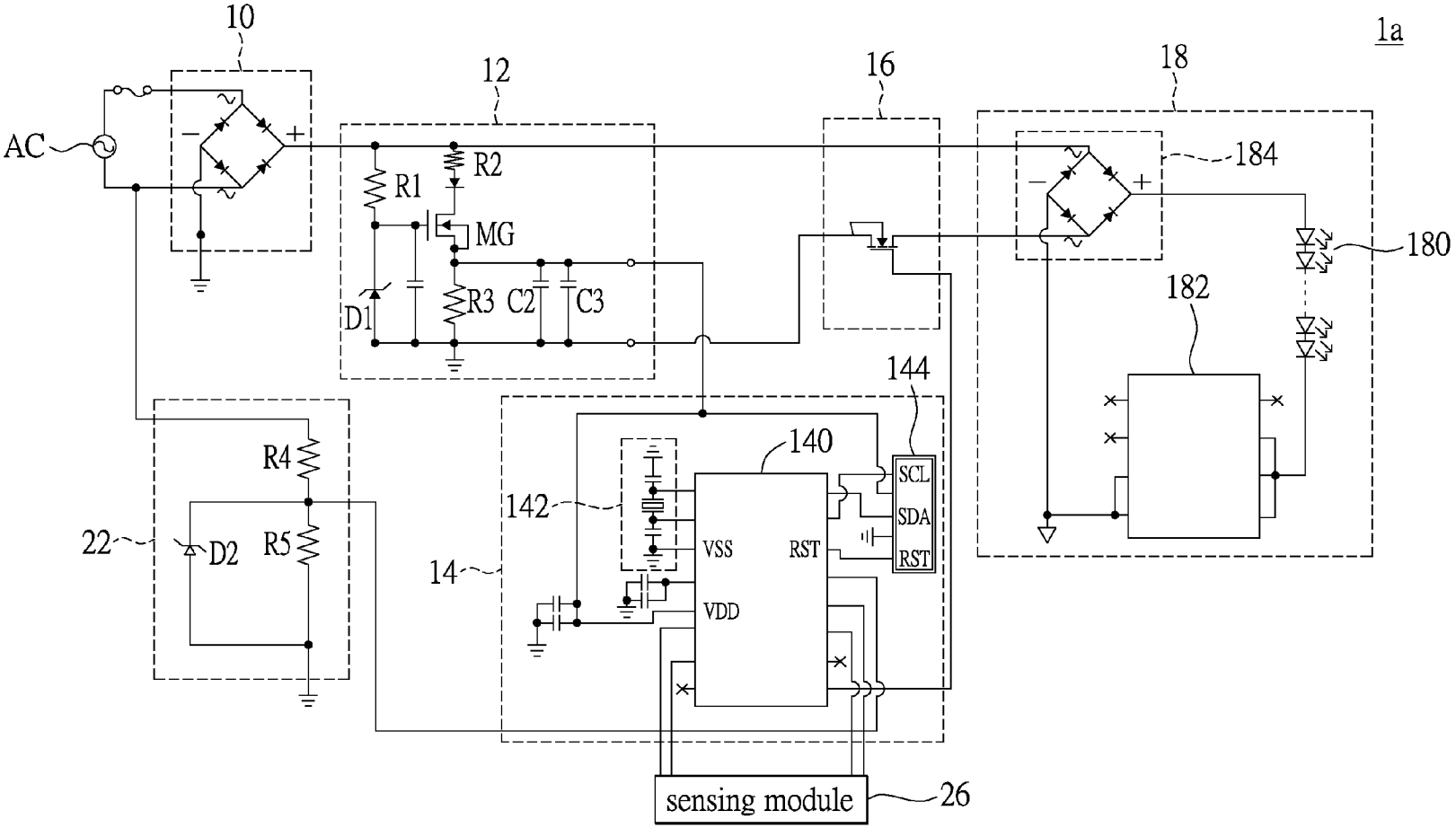
FIG. 3 shows a circuit diagram of an AC light emitting device of another embodiment of the instant disclosure.

FIG. 3 shows a circuit diagram of an AC light emitting device of another embodiment of the instant disclosure. Please refer to FIG. 3. The AC light emitting device 1*a* shown in FIG. 3 is similar to the AC light emitting device 1 shown in FIG. 2. In addition, for convenience, similar reference numbers or symbols refer to the same elements. The differences between the AC light emitting devices 1*a* and 1 are the voltage division module 22 and the sensing module 26. The voltage division module 22 is electrically connected to the control unit 140 and the AC power. The sensing module 26 is electrically connected to the control unit 140.

The voltage division module 22 can be the voltage division circuit. In practice, the control module 14 obtains power data of the AC power via the voltage division module 22. The resistance of the resistor R5 is larger than the resistance of the resistor R4. In other embodiments, the resistance of the resistor R5 is smaller than or equal to the resistance of the resistor R4. The type of the voltage division module 22 is not limited herein.

The sensing module 26 is electrically connected to the control module 14. The sensing module 26 is configured to sense the entering of an object within a sensing area. In practice, the sensing module 26 can be an infrared sensor, a microwave sensor, a Bluetooth sensor, a radio frequency sensor or other sensors, and the type of the sensing module 26 is not limited herein.

When the sensing module 26 senses the entering of an object, the sensing module 26 outputs a sensing signal to the control module 14. The sensing signal makes the control module 14 output the pulse waveform signals having different duty cycles to the switching unit 16. When the sensing module 26 does not sense the entering of an object, the control module 14 controls the turning on or off of the switching unit 16 via one of the predetermined dimming modes.

For example, the control module 14 has a plurality of predetermined dimming modes. When the control module 14 receives the sensing signals, the control module 14 is operating in the predetermined dimming mode that is 100% dimming. Thus, the control module 14 outputs a pulse waveform signal having the 100% dimming duty cycle to the switching unit 16, such that the AC lighting emitting module 18 outputs the light having 100% luminosity.

On the other hand, when the control module 14 does not receive the sensing signal, the control module 14 is operating in the predetermined dimming mode that is 25% dimming. Thus, the control module 14 outputs a pulse waveform signal having the 25% dimming duty cycle to the switching unit 16, such that the AC lighting emitting module 18 outputs the light having 25% luminosity. In other embodiments, when the control module 14 does not receive the sensing signal, the control module 14 is operating in the predetermined dimming mode that is 0% dimming, or in another predetermined dimming mode that has a low dimming percentage. The type of the AC light emitting device 1*a* is not limited herein.

Figure 4:
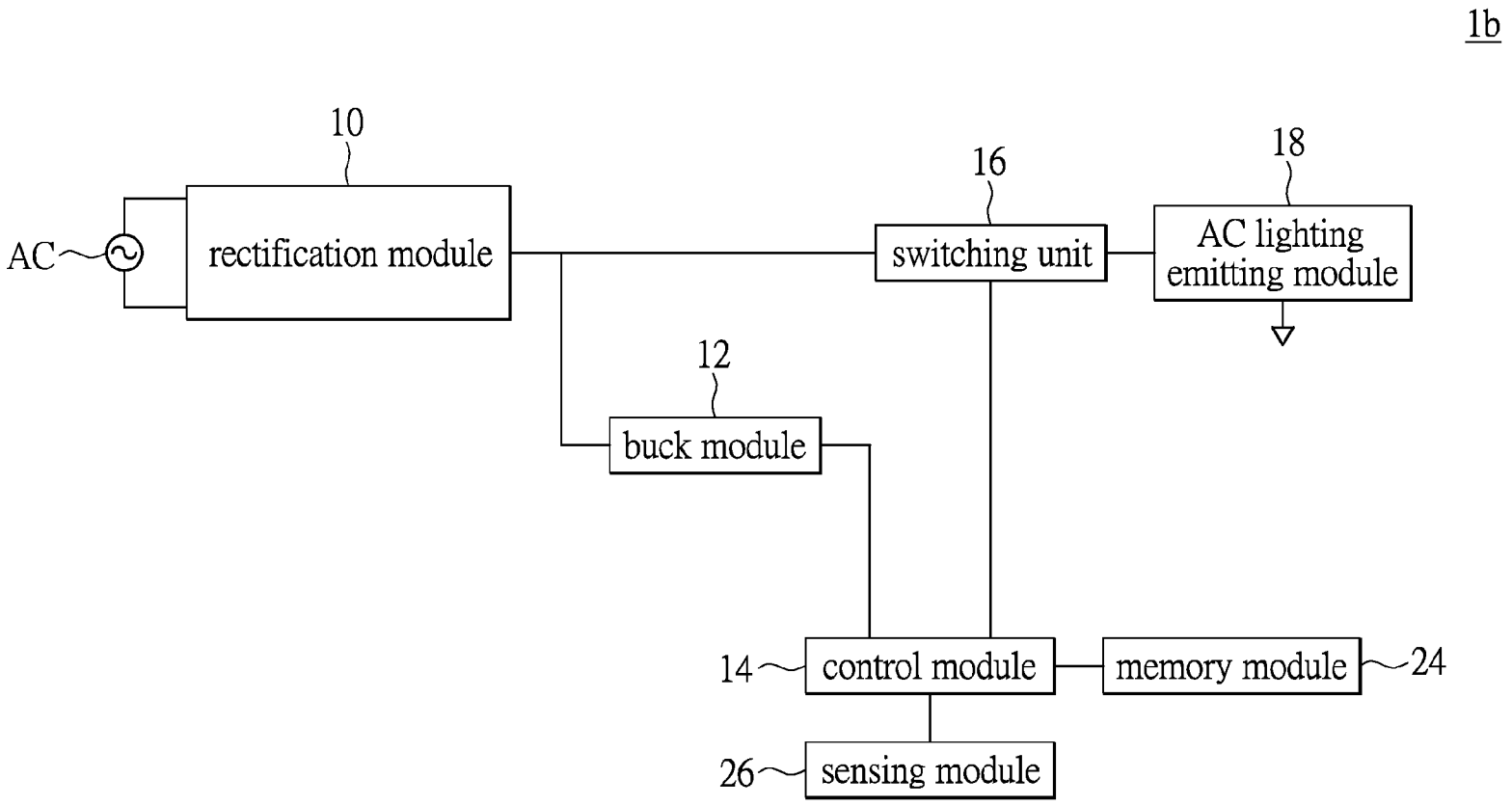
FIG. 4 shows a schematic drawing of an AC light emitting device of another embodiment of the instant disclosure.

FIG. 4 shows a schematic drawing of an AC light emitting device of another embodiment of the instant disclosure. Please refer to FIG. 4. The AC light emitting device 1*b* shown in FIG. 4 is similar to the AC light emitting device 1 shown in FIG. 1. In addition, for convenience, similar reference numbers or symbols refer to the same elements. The differences between the AC light emitting devices 1*b* and 1 are the memory module 24 and the sensing module 26.

The memory module 24 and the sensing module 26 are electrically connected to the control module 14, respectively.

The memory module 24 can be a nonvolatile memory, a volatile memory, an SD card, a flash memory or the combination thereof. For example, the memory module 24 stores one or more predetermined dimming modes, or one or more pulse waveform signals having different duty cycles. The type of the memory module 24 is not limited herein.

Figure 5:
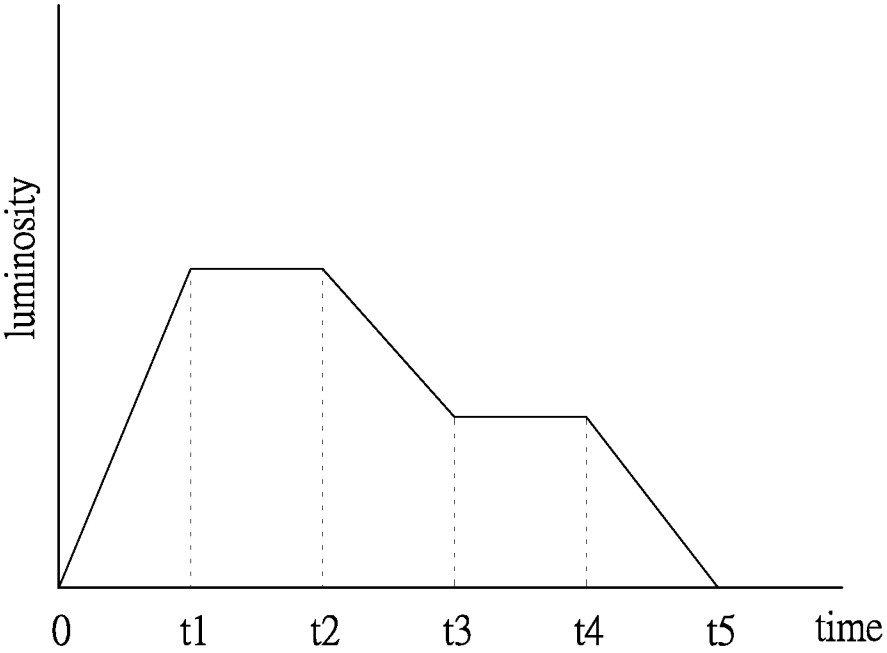
FIG. 5 shows a waveform diagram of an AC light emitting device that senses the luminosity with time in another embodiment of the instant disclosure.

FIG. 5 shows a waveform diagram of an AC light emitting device that senses the luminosity with time in another embodiment of the instant disclosure. Please refer to FIG. 5. When the sensing module 26 shown in FIG. 3 and FIG. 4 senses the entering of an object, the AC lighting emitting module 18 outputs the lights having different luminosities.

In this embodiment, the sensing module 26 senses the entering of an object, and the AC lighting emitting module 18 outputs the light within the time duration from 0 to t1. The luminosity of the light linearly increases from zero to a high luminosity. However, for the general lighting device, when it senses the entering of an object, its light luminosity would increase from zero to a high luminosity instantaneously. Since the light luminosity of the general lighting device is in a ladder type, the passerby, the visitor, the user or the third party might be sacred by the lights emitted by the lighting device.

The light luminosity of the AC lighting emitting module 18 in this embodiment increases linearly from zero to a high luminosity, but does not increase instantaneously from zero to a high luminosity. Thus, the light luminosity of the AC lighting emitting module 18 would not scare the user, visitor, passerby or the third party when there is an object entering.

After that, within the time duration from t1 to t2, the AC lighting emitting module 18 continues to output the light with a high luminosity. The control module 14 outputs the pulse waveform signal having the 100% dimming duty cycle to turn on or off the switching module. The control module 14 can make the pulse waveform signal having the 100% dimming duty cycle output for 10 seconds or for the predetermined time duration according to the predetermined dimming mode.

When the object leaves the sensing area and the sensing module 26 does not sense the entering of the object, within the time duration from t2 to t3, the AC lighting emitting module 18 outputs the light wherein the light luminosity linearly decreases from a high luminosity to a low luminosity. The light luminosity of the AC lighting emitting module 18 in this embodiment decreases linearly from a high luminosity to a low luminosity, but does not decrease instantaneously from a high luminosity to a low luminosity. Thus, the luminosity of the AC light emitting device in this embodiment would slowly but not instantly decrease to a low level, and the user, the visitor, the passerby or the third party would not be scared or suddenly be unable to see things around.

Within the time duration from t3 to t4, the AC lighting emitting module 18 continues to output the light having low luminosity. The control module 14 outputs the pulse waveform signal having the 25% dimming duty cycle to turn on or off the switching module. The control module 14 can make the pulse waveform signal having the 25% dimming duty cycle output for 10 seconds or for the predetermined time duration according to the predetermined dimming mode.

Within the time duration from t4 to t5, the AC lighting emitting module 18 outputs a light, wherein the light luminosity linearly decreases from a low luminosity to zero. In this embodiment, the light luminosity of the AC lighting emitting module 18 decreases linearly from a low luminosity to zero, but does not decrease instantaneously from a low luminosity to zero. Thus, the luminosity of the AC light emitting device in this embodiment would slowly but not instantly decrease to a low level, and the user, the visitor, the passerby or the third party would not be scared or suddenly unable to see things around. As known by those skilled in the art, the slope of the luminosity curve, the time duration for light emitting, increasing or deleting certain periods of time or other operations can be used or adjusted depending on need, and the operation type of the AC light emitting device 1 is not limited herein.

To sum up, the AC light emitting device provided by the instant disclosure comprises a buck module, a switching unit, a control module and an AC lighting emitting module. The control module outputs a pulse waveform signal to the switching unit according to the input voltage and a dimming signal. The switching unit turns on or off the AC lighting emitting module according to the pulse waveform signal, such that the AC lighting emitting module outputs lights with different luminosities. The pulse waveform signal is a voltage waveform generated according to the pulse-triggering phase and the input voltage. The pulse-triggering phase is related to the duty cycle of the pulse waveform signal. The pulse waveform signal is generated according to the positive half waveform of the input voltage, which is similar to a pulse width modulation signal.

Moreover, the AC light emitting device provided by the instant disclosure further comprises a dimmer module and a sensing module. The dimmer module is configured to adjust the predetermined dimming mode of the control module, such that the control module outputs the pulse waveform signals having different duty cycles to the switching unit. Thereby, the AC light emitting device provided by the instant disclosure actually can increase the convenience of the use and operation of the lighting device.

The descriptions illustrated supra sets forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. An AC light emitting device, electrically connected to an AC power, the AC power rectified by a rectification module and inputting an input voltage, the AC light emitting device comprising:

a buck module, electrically connected to the rectification module;

a switching unit, electrically connected to the rectification module and the buck module;

a control module, electrically connected to the switching unit and the buck module; and an AC lighting emitting module, electrically connected to the switching unit;

wherein the control module outputs a pulse waveform signal to the switching unit according to the input voltage and a dimming signal, and the switching unit turns on or off the AC lighting emitting module according to the pulse waveform signal.

2. The AC light emitting device according to claim 1, wherein the control module has a plurality of predetermined dimming modes, the predetermined dimming modes instruct the control module to output pulse waveform signals having different duty cycles to the switching unit, and the control module generates the pulse waveform signal according to a pulse-triggering phase and the input voltage.

3. The AC light emitting device according to claim 2, further comprising a dimmer module, electrically connected to the control module, the dimmer module having a plurality of dimming scales, the dimming scales instructing the control module to output the pulse waveform signals having different duty cycles to the switching unit.

4. The AC light emitting device according to claim 2, further comprising a sensing module, electrically connected to the control module, and the sensing module configured to sense the entering of an object within a sensing area;

wherein the sensing module outputs a sensing signal to the control module when the sensing module senses the entering of the object, and the sensing signal instructs the control module to output the pulse waveform signal to the switching unit; and wherein the control module controls the turning on or off the switching unit via one of the predetermined dimming modes when the sensing module does not sense the entering of the object.

5. The AC light emitting device according to claim 1, wherein the buck module comprises a plurality of resistors, a diode, a transistor switch and a plurality of capacitors, the gate of the transistor switch is electrically connected to one of the resistors and the cathode of the diode, and the anode of the diode is electrically connected to the source of the transistor switch.

6. The AC light emitting device according to claim 5, wherein the resistors are a first resistor, a second resistor, a third resistor, the first resistor electrically connected to the cathode of the diode, the gate of the transistor switch and the rectification module, the second resistor is electrically connected to the drain of the transistor switch and the rectification module, and the capacitors are connected to the third resistor in parallel.

7. The AC light emitting device according to claim 1, wherein the switching unit is a power transistor, the gate of the power transistor is electrically connected to the control module, the source and the drain of the power transistor are electrically connected to the buck module and the AC lighting emitting module respectively.

8. The AC light emitting device according to claim 1, further comprising a voltage division module, electrically connected between the control unit and the AC power.

9. The AC light emitting device according to claim 1, further comprising a memory module, electrically connected to the control module, the control module comprising a control unit, an oscillation unit and a coding unit, and the control unit electrically connected to the buck module, the oscillation unit and the coding unit.

10. The AC light emitting device according to claim 1, wherein the AC lighting emitting module comprises a rectification unit, an AC operation unit and at least one AC light emitting diode, and the rectification unit is electrically connected to the AC operation unit and the at least one AC light emitting diode.

* * * * *